US005489932A

United States Patent [19]

Ceschin et al.

[11] Patent Number: 5,489,932

[45] Date of Patent: Feb. 6, 1996

[54] INK CONTAINER FOR AN INK JET PRINT HEAD

[75] Inventors: Danilo Ceschin, Candia; Rinaldo Ferrarotti, Vercellese; Roberto Morandotti, Mercenasco; Alessandro Scardovi, Ivrea, all of Italy

[73] Assignee: Ing. C. Olivetti & C., S.p.A., Ivrea, Italy

[21] Appl. No.: 35,606

[22] Filed: Mar. 23, 1993

[30] Foreign Application Priority Data

Mar. 26, 1992 [IT] Italy ..... TO92A0271

[51] Int. Cl.[6] ..... B41J 2/175; B41J 2/19

[52] U.S. Cl. ..... 347/87; 347/92

[58] Field of Search ..... 346/140 R, 75, 346/140.1; 347/87, 85, 86, 92

[56] References Cited

U.S. PATENT DOCUMENTS

| | | | |
|---|---|---|---|
| 2,214,636 | 12/1938 | Hutchens | 346/140.1 |
| 3,967,286 | 6/1976 | Andersson et al. | 346/140 R |
| 4,794,409 | 12/1988 | Cowger et al. | 346/140 PD |
| 4,831,389 | 5/1989 | Chan | 346/140 PD |
| 4,929,969 | 5/1990 | Morris | 346/140 R |
| 4,931,811 | 6/1990 | Cowger et al. | 346/140 R |
| 4,992,802 | 2/1991 | Dion et al. | 347/87 |
| 5,047,790 | 9/1991 | Cowger et al. | 347/87 |
| 5,103,243 | 4/1992 | Cowger | 346/1.1 |
| 5,182,581 | 1/1993 | Kashimura et al. | 346/140 R |
| 5,199,470 | 4/1993 | Goldman | 14/1 |

FOREIGN PATENT DOCUMENTS

| | | | |
|---|---|---|---|
| 0041777 | 12/1981 | European Pat. Off. . | |
| 0314474 | 5/1989 | European Pat. Off. . | |
| 0320165 | 6/1989 | European Pat. Off. . | |
| 4012708 | 10/1991 | Germany | 346/140 R |
| 22952 | 1/1986 | Japan | 347/87 |
| 288652 | 12/1991 | Japan | 346/140 R |

*Primary Examiner*—N. Le
*Attorney, Agent, or Firm*—Banner & Allegretti

[57] ABSTRACT

An ink container for an ink jet print head has a main tank filled with an absorbent fibrous material which holds ink by capillary action. A feed channel conducts ink from the main tank to a feed chamber whence it passes to the head. An auxiliary tank (30) is fixed to the side of the main tank (15) and communicates with it by a channel at the end of the main tank having the feed channel. The container can be refilled by inserting ink through an aperture into the auxiliary tank from where it passes into the main tank by capillary action.

10 Claims, 2 Drawing Sheets

INK CONTAINER FOR AN INK JET PRINT HEAD

BACKGROUND OF THE INVENTION

The present invention relates to an ink container for an ink jet print head, comprising a main ink tank, a feed chamber intermediate between the main tank and the head, and a feed channel connecting the main tank with the feed chamber.

The ink container may be of the type which is separable from the print head, in the form of a replaceable cartridge, or else of the type which is fixed to the print head. The print head may, for example, be of the type in which the ink drops are expelled through nozzles by the rapid heating of the ink inside cells communicating with the nozzles.

In the following description, reference will be made by way of example to the case of a container which is fixed to the head, though it should be understood that the invention is applicable to other types of ink container whether fixed or not fixed to the print head.

U.S. Pat. No. 4,831,389 discloses an ink jet print head fixed to its own ink tank and mounted on a moveable carriage of a printer. The tank is filled with a porous ink-soaked foam body. In order to supply the porous foam with fresh supplies of ink to replace that consumed in the course of printing, a sharp hollow needle is passed into the foam body through the tank wall. The needle is connected via a capillary tube to a large-capacity container located in a fixed position at a distance from the head. From here the ink is conveyed to the foam body by capillary action.

The capillary tube, in itself a very delicate component, may be damaged by the continual flexing to which it is subjected by the back and forth movements of the carriage on which the print head is mounted. Moreover if pigmented inks are used, the capillary tube may become blocked by deposits of pigments when the printer is out of use for long periods.

Also known is a method of manually refilling the tank of an ink jet print head, for example that described in U.S. Pat. No. 4,929,969, in which the tank fixed to the print head is packed with a foam body impregnated during manufacture with a predetermined amount of ink.

In order to avoid throwing away the tank/head unit when the ink is exhausted, a refill device described in Italian Utility Model Application No. TO91U 000234 can be used. This consists of a flexible container containing the ink and having a thin tube which is introduced into the empty tank through an aperture in its cover. By manually compressing the flexible container, a certain amount of ink is introduced into the foam body of the print head.

This method of refilling is complicated and hazardous because the insertion of the refilling tube into the foam body may damage its capillary structure, reducing its ability to maintain the pressure drop needed for a correct supply to be maintained to the head. The violent injection of a squirt of ink may create air bubbles in the foam body which remain trapped in the pores and in the capillary channels of the foam body, affecting the best pressure drop values. Furthermore there is always the possibility that the ink may leak and get over the operator or surrounding objects.

SUMMARY OF THE INVENTION

The technical problem or object of the present invention is therefore how to provide a container for an ink jet print head that does not have the disadvantages described above.

Another aspect of the invention is the provision of a container for an ink jet print head that can be easily refilled from the exterior.

The invention is defined in the independent claims below to which reference should now be made. Advantageous features are set forth in the appendent claims.

In a preferred embodiment of the invention, described in more detail below with reference to the drawings, an ink container for an ink jet print head has a main tank filled with an absorbent fibrous material which holds ink by capillary action. A feed channel conducts ink from the main tank to a feed chamber, whence it passes to the print head. An auxiliary tank is fixed alongside the main tank, sharing a wall with the main tank, and communicates with it by a channel at that end of the main tank which has the feed channel. The container can be refilled by inserting ink through an aperture into the auxiliary tank, from where it passes into the main tank by capillary action.

BRIEF DESCRIPTION OF THE DRAWINGS

The invention will be described in more detail by way of example with reference to the accompanying drawings, in which.

DETAILED DESCRIPTION OF THE PREFERRED EMBODIMENTS

Figure 1:
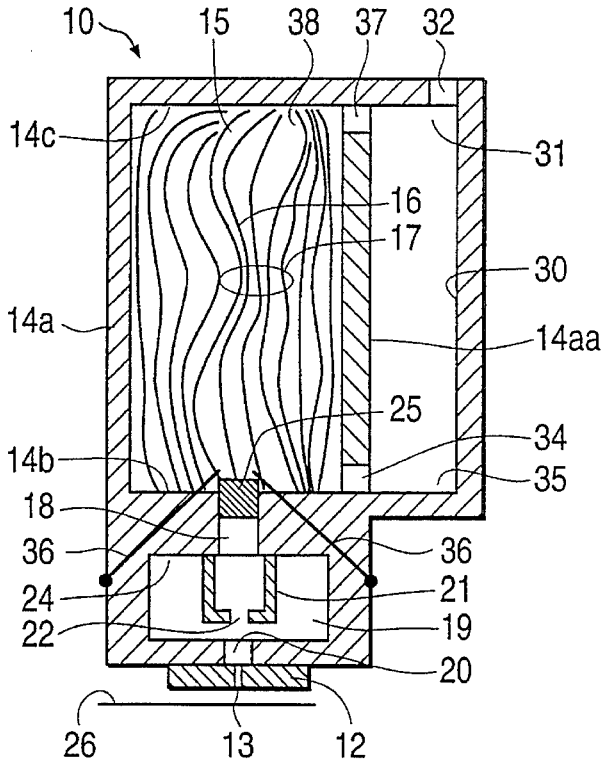
FIG. 1 is a view in partial section of an ink container embodying the invention.

With reference to FIG. 1, the numeral 10 indicates an ink container for feeding ink to an ink jet print head 12 fixed to the container 10.

The print head 12, which is of the "on demand" type, is preferably thermal; that is the ink drops are expelled from one or more nozzles 13 by means of the rapid heating of a small amount of ink contained in cells, not shown, communicating with the nozzles 13.

The container 10 is defined by rigid walls 14 of a plastics material compatible with the inks used in this type of head and known per se. Specifically, the container 10 is defined by lateral 14*a*, base 14*b* and upper 14*c* walls.

The walls 14 define a main tank 15 in which an absorbent ink body 16 capable of soaking up a certain amount of ink by capillary action is inserted. The absorbent body 16 is formed by a mass of fibres 17 packed side by side in the tank 15. The fibres 17 are formed by fine filaments lying parallel with each other, made of hydrophilic resins such as polyester, polyamide resins, or natural fibres from plants or other sources.

The cross-section of each fibre is generally circular with a diameter of between 5 μm and 100 μm and preferably between 15 μm and 35 μm. The fibres 17 are preferably not shorter than the distance between the base wall 14*b* and the upper wall 14*c* and are packed into the tank 15 with a degree of packing equal to between 2% and 30% of the free internal volume of the tank 15.

The degree of packing may vary according to the dimensions of the fibres and the value of the capillary pressure drop needed for the head 12 to work properly. For example, when polyester fibres with a diameter of 25 μm were used, a pressure drop of between 10 cm and 18 cm ($H_2O$) was obtained.

The fibres 17 in the main tank 15 may be arranged in various ways; for example, the lower ends 17*a* may lie generally parallel to the base wall 14*b*, or generally perpendicular to said wall, or they may lie at random with no preferred direction.

It is also acceptable for the ends 17*a* to lie in the direction of a feed channel 18, which passes through the wall 14*b* to allow the main tank 15 to communicate with a feed chamber 19, which in turn communicates through an aperture 20 with the head 12. The aperture 20 may be circular or an elongate slot.

The channel 18 reaches into the interior of the chamber 19 in the direction of the head 12 in the form of a tubular element 21 fixed to the wall 14*b* and terminating in a hole 22 with a smaller diameter than the internal diameter of the tubular element 21 and formed in a diaphragm.

The tubular element 21 creates inside the chamber 19 against the wall 14*b* a space 24 or pocket in which any air bubbles entering from the nozzles 13 through the aperture 20 are trapped and prevented from rising up into the channel 18. This is especially advantageous when the movably-mounted print head 12 and the container 10 are used for printing in a vertical position as indicated in FIG. 1, for printing on horizontal stock 26. To encourage bubbles to collect only in the space 24, the hole 22 may be offcentre with respect to the channel 20 (by an amount no greater than the external radius of the tubular element 21).

Inside the channel 18, level with the wall 14*b*, a filter plug 25 of porous capillary material is installed, having the function of preventing impurities and/or air bubbles from passing from the tank 15 to the head 12.

Figure 4:
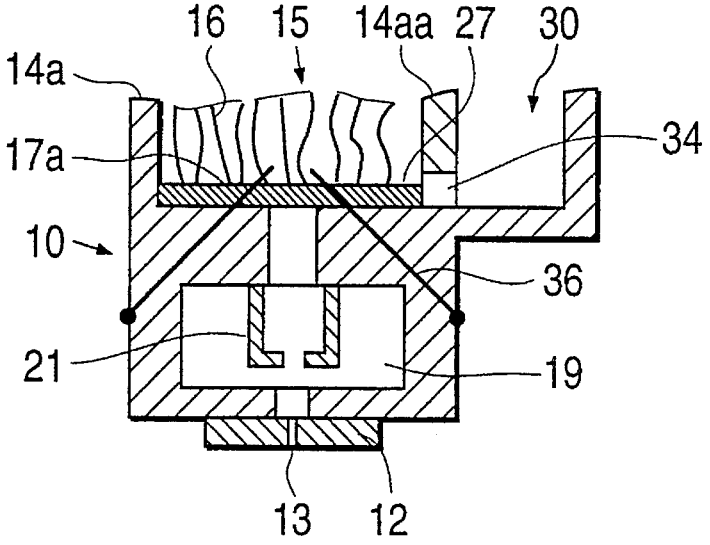
FIG. 4 shows another embodiment of the container.

Alternatively a layer 27 (FIG. 4) of porous material, for example a porous ceramic or Porex (trade mark) may be placed on the base 14*b* of the tank 15. In the version actually tested, this layer of porous material is a polyether urethane foam with appropriate dimensions. In this case the ends 17*a* of the fibres 17 may lie in the most appropriate direction with respect to the layer 27 in order that the capillary channels formed by the fibres 17 maintain hydraulic continuity with the layer 27 over the whole extent of the internal surface of the wall 14*b*.

The absorbent body 16 may also consist of fibres arranged in the form of a nonwoven material. This material consists of one or more layers of synthetic fibres arranged at random on top of each other and joined together at their points of contact, thus forming a flat structure similar to a sheet.

These materials exist in different thicknesses from about 0.1 mm to more than 1 mm. Those employed in the present embodiments are between 0.1 mm and 0.7 mm thick.

The fibres 17 may preferably consist of polyester, polyamide or polyethylene and may have a variety of diameters as indicated above.

The following are examples of trade names by which these materials are known:

Reeemay (T.M. of Reemay Inc.): polyester

Tekton (T.M. of Reemay Inc.): polypropylene

Sontara (T.M. of Du Pont): polyester

Nordlys (T.M. of Nordlys): polyester, polyamide etc.

The sheets, cut to the desired dimensions, are placed on top of each other in well defined quantities to form a "pack" which is placed in the tank; alternatively the "pack" may be obtained by concertina-style folding a sheet of this material having the desired thicknesses. In all cases the number of layers making up the "pack" is precisely determined, because varying this number (given the same thickness of material) leads to a greater or lesser compaction of the fibres and hence controls the resulting capillary action.

For example, with around 30 layers of nonwoven having a thickness of 0.4 mm packed to a thickness of 11 mm, the resulting capillarity is approximately 15 cm ($H_2O$). In this case the degree of packing is approximately 20%.

During manufacture, before fixing the upper wall 14*c* to the container 10, thereby closing it, the fibres 17 are soaked with the maximum amount of ink compatible with the degree of packing employed.

To avoid having to throw away the unit comprising the head 12 and the container 10 when the ink is exhausted, an auxiliary refill tank 30 is constructed adjacent to and fixed to the tank 15. The tank 30 shares at least one of the side walls 14*a*, for example in FIG. 1 the wall 14*aa*, with the tank 15.

In the normally ink-free upper part 31 of the tank 30 is an aperture 32 communicating with the outside. The tank 30 communicates with the tank 15 by means of a channel or aperture 34 let into its lower part 35, adjacent to the wall 14*b* or to the layer 27, if present.

Since there are two electrodes 36 on the bottom of the tank 15 for indicating in a known manner when the ink is about to run out, the operator may, by a simple operation, introduce through the aperture 32 of the auxiliary tank 30 a predetermined amount of ink to refill the main tank 15.

In this way the ink introduced into the tank 30 passes through the aperture 34 into the main tank 15, attracted by the capillary action of the fibres 17 which soak up the new ink from the bottom, thereby preventing the formation of air bubbles between the fibres.

To prevent any air bubbles present in the ink introduced into the auxiliary tank 30 from entering between the fibres 17, the aperture 34 may simply be made as a series of holes of sufficiently small diameter, or as a sufficiently narrow crack, to hold back any air bubbles.

The tank 15 also communicates with the tank 30 via a second channel 37 located in its upper part 38. This channel 37 allows air to escape to the exterior through the aperture 32.

By virtue of the presence of the auxiliary tank 30, the container 10 may be made with small dimensions to contain a small amount of ink, for example 4 cc, so that it can be used on small indicator for the main tank comes on, the operator, during a brief interruption to the printing, introduces into the auxiliary tank 30 a measured amount of ink, using for example a syringe or hand pump as described earlier. Within about 5–10 seconds the ink will have been drawn from the tank 30 by the fibres 17 and the head 12 will once again be ready to continue its interrupted printing.

Renewal of the ink in the container may be repeated many times throughout the life of the print head itself.

Figure 2:
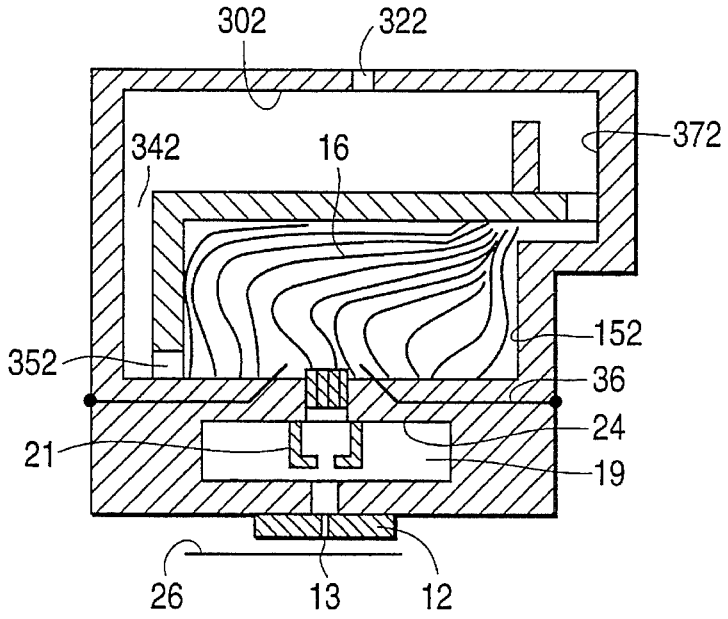
FIGS. 2 and 3 show different embodiments of the container shown.
Figure 3:
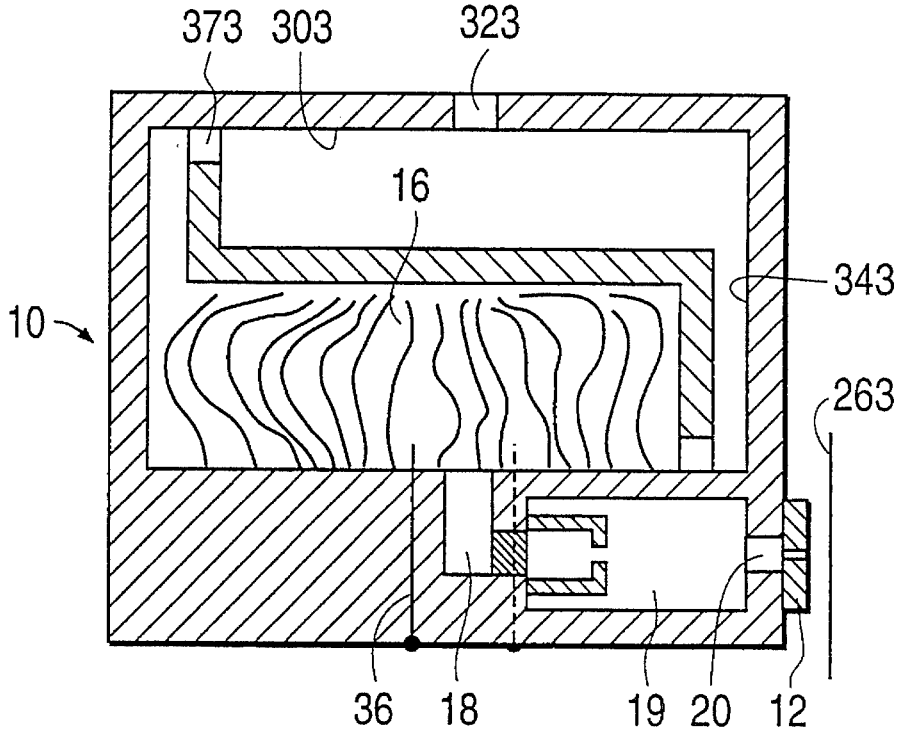

FIGS. 2 and 3 show two different possible embodiments derived from FIG. 1. Similar reference numerals are used for corresponding parts, with the number 2 or 3 respectively added to the numeral for the corresponding element of FIG. 1.

In FIG. 2, the auxiliary tank 302 is located on top of the main tank 152. A first channel 342 allows the new ink to pass from the tank 302 to the tank 152 through the entrance in its lower part 352. A second channel 372 allows communication between the higher, ink-free parts of both tanks, while the auxiliary tank communicates with the exterior through an aperture 322.

FIG. 3 shows a similar embodiment to that shown in FIG. 2, in which the head emits the ink drops horizontally onto vertical stock 263.

It will be understood that additional or replacement parts and modifications of shape may be made to the ink container for an ink jet print head without thereby departing from the scope of the present invention.

We claim:

1. An ink container for an ink jet print head comprising:

a main tank having a free internal volume defined by rigid walls and filled with an absorbent material provided with capillary action for soaking up a suitable amount of ink to feed to said head, a feed chamber intermediate between said main tank and said head, having in common with said main tank at least one of said rigid walls which is a first dividing wall between said main tank and said feed chamber, and communicating with said head through a first aperture, a feed channel connecting said main tank to said feed chamber, an auxiliary tank having in common with said main tank at least one of said rigid walls which is a second dividing wall between said main tank and said auxiliary tank and being fixed to said main tank, said auxiliary tank having a second aperture communicating with the outside and a first channel through said second dividing wall coupling said auxiliary tank with said main tank, in order to refill from an outside source through said second aperture a predetermined amount of ink to be soaked in said absorbent material by said capillary action, wherein said feed channel comprises a tubular body extending into said feed chamber and having two opposite ends, the first of said ends being fixed to said first dividing wall between said main tank and said feed chamber, and the second of said ends being positioned at a predetermined distance from said head, said tubular body having a circular cross-section of a predetermined first diameter, and said second of said ends being closed by a diaphragm in which a circular hole of a predetermined second diameter smaller than said first diameter is bored, whereby air bubbles introduced into said feed chamber through said head are prevented from entering inside said tubular body.

2. A container according to claim 1, wherein said hole is off center with respect to said first aperture through which said feed chamber communicates with said head, by an amount no greater than half of said first diameter of said tubular body.

3. A container according to claim 1, wherein said absorbent material comprises fibrous material composed of many layers, each of said layers being formed by fibers packed together so as to form a flat structure, said fibrous material being soaked with said suitable amount of ink to feed to said head.

4. A container according to claim 3, wherein said fibrous material is a material selected from the group consisting of hydrophilic polyester fibers, polyamide fibers, and natural fibers.

5. A container according to claim 1, wherein said absorbent material comprises fibrous material composed of parallel fibers packed together so as to create many capillary channels between said fibers, said fibrous material being soaked with said suitable amount of ink to feed to said head.

6. A container according to claim 5, wherein said fibrous material is a material selected from the group consisting of hydrophilic polyester fibers, polyamide fibers, and natural fibers.

7. A container according to claim 6, wherein said fibers have a cross section which is circular with a diameter of between 5 μm and 200 μm.

8. A container according to claim 5, wherein said fibers are packed together into said main tank with a degree of packing equal to between 2% and 30% of said internal volume of said main tank.

9. A container according to claim 5, in which said fibers have one end placed in contact with a layer of porous material arranged inside said main tank on said first dividing wall between said main tank and said feed chamber.

10. A container according to claim 9, in which said layer of porous material comprises a polyether urethane foam.

* * * * *